US005149087A

United States Patent [19]

Thompson, Jr.

[11] Patent Number: 5,149,087

[45] Date of Patent: Sep. 22, 1992

[54] TURF REPAIR TOOL INCLUDING CLUB SUPPORT

[76] Inventor: James W. Thompson, Jr., 1680 Midland Rd., Southern Pines, N.C. 28387

[21] Appl. No.: 832,960

[22] Filed: Feb. 10, 1992

[51] Int. Cl.[5] ..... A63B 37/00; B65B 67/12

[52] U.S. Cl. ..... 273/32 B; 248/96; 248/156; 172/438; 172/713

[58] Field of Search ..... 273/32 R, 32 A, 32 B, 273/32 E, 32 H; 248/96, 156; 172/438, 713

[56] References Cited

U.S. PATENT DOCUMENTS

| | | | |
|---|---|---|---|
| 1,769,011 | 7/1930 | Bickford | 248/96 |
| 2,716,432 | 8/1955 | Duffy | 248/96 X |
| 2,858,868 | 11/1958 | Wallace | 273/32 E |
| 2,887,137 | 5/1959 | Robb | 273/32 E X |
| 3,219,083 | 11/1965 | Asquith | 273/32 R X |
| 4,063,731 | 12/1977 | Kitay | 273/32 B |
| 4,940,201 | 7/1990 | Kurth | 248/156 X |
| 5,029,854 | 7/1991 | Laskowitz et al. | 273/32 B |

*Primary Examiner*—George J. Marlo
*Attorney, Agent, or Firm*—Rhodes, Coats & Bennett

[57] ABSTRACT

The present invention entails a utility golf accessory in the form of an elongated rod having a handle on one end and a ground penetrating fork on the other end. The ground penetrating fork functions to repair ball marks and divots. Pivotally connected to the handle end of the elongated rod is a hook which functions to support one or more golf clubs that are unattended. In particular, the elongated rod can be anchored in the ground and one or more golf handles from golf clubs can be leaned against the hook such that the golf club handles are supported in an inclined fashion adjacent the ground penetrating ground accessory.

3 Claims, 1 Drawing Sheet

TURF REPAIR TOOL INCLUDING CLUB SUPPORT

FIELD OF THE INVENTION

The present invention relates to golf accessories, and more particularly to a ground engaging rod that is designed to be used to repair ball marks and divots and which also functions to support one or more golf clubs.

BACKGROUND OF THE INVENTION

Over the past few years, hardly any sport can claim the success and growth rate that is found in the sport of golf. It is one of the most popular sports in the world today, as it played with great enthusiasm by young adults, adults and people of all ages.

It is not uncommon for a player to carry at least two golf clubs in his or her hand around a golf green. For example, it is common for a golfer to pull a chipping wedge and a putter from his or her golf bag and carry both clubs in and around the green while completing a hole. In addition, the same golfer usually carries a ball mark or divot repair device. When either pitching or putting, the golfer has to find a place to lay or temporarily leave at least one club. Often, the golfer simply lays the club on the green or on the fairway in an area in close proximity to the ball that is to be played. One problem with this is that the green or fairway, in some cases, can be damp or even very wet. Thus, the golf club, and particularly the handle portion, becomes wet from the moisture associated with the green or with the fairway. Besides this, it is not uncommon for a golfer, while in the vicinity of a green, to spot ball marks and other damage to the actual surface of the green or the fairway. In too many cases, these ball marks, divots, etc., go unrepaired for one reason or another. It is speculated that one of the reasons that ball marks and divots go unrepaired is the fact that many of the implements used to repair these areas are essentially hand-held devices and this requires the golfer to do excessive bending in and around the green and fairway areas to repair such.

Therefore, there has been and continues to be a need for a golf accessory that is designed to support one or more golf clubs in an upright or inclined position when not being used. In addition, there is a need for a golf accessory that will encourage and facilitate the repair of ball marks and divots.

SUMMARY AND OBJECTS OF THE INVENTION

The present invention entails a golf accessory that addresses both of the above referred to problems. In particular, the utility golf accessory of the present invention is designed to suport one or more golf clubs in an upright or slightly inclined position about the golf green when the clubs are not being used. The same utility golf accessory is also designed to permit a golfer to repair ball marks and divots while in a standing or upright position. In this regard, the present invention entails an elongated rod having a ground penetrating end that includes a fork that is used to repair ball marks and divots. Also, the same elongated rod includes a pivotally mounted hook that is secured about the handle end of the elongated rod for receiving and holding the handle portions of one or more golf clubs that are unattended.

It is therefore an object of the present invention to provide a utility golf accessory for receiving and supporting the handle ends of one or more golf clubs.

Still a further object of the present invention resides in the provision of a utility accessory that includes an elongated rod with a ball repair fork secured to one end thereof which enables a ball mark to be repaired by a golfer from a generally upright standing position.

Another object of the present invention resides in the provision of a light-weight and easy to handle utility golf accessory that is adapted to support one or more golf clubs in a standing upright mode while at the same time being designed to prepare ball marks and divots.

Another object of the present invention resides in the provision of a utility golf accessory that is provided with a pivotally mounted hooked-shape support device for receiving the handle portion of one or more golf clubs, such that the golf clubs can be propped against the hook-shaped member of the golf accessory and supported in an upright or in an inclined posture.

Other objects and advantages of the present invention will become apparent and obvious from a study of the following description and the accompanying drawings which are merely illustrative of such invention.

DETAILED DESCRIPTION OF THE INVENTION

Figure 1:
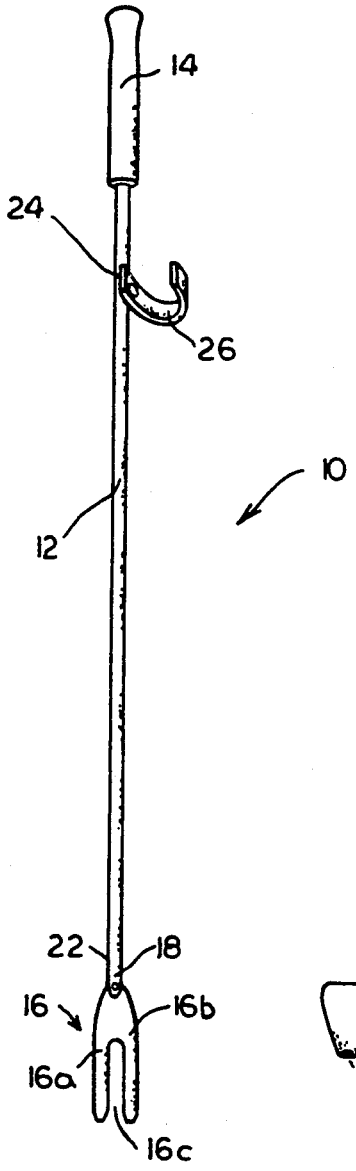
FIG. 1 is a perspective view of the utility golf accessory of the present invention.

With further reference to the drawings, the utility golf accessory of the present invention is shown therein and indicated generally by the numeral 10. Golf accessory 10 basically comprises an elongated rod 12 having a handle-end portion and a ground penetrating-end portion. Secured to the handle-end portion, is a handle 14. About the ground penetrating-end portion of the rod 12 there is formed a ground penetrating end 18. Secured to the ground penetrating end 18 is a structure for repairing ball marks and divots. This structure for preparing ball marks and divots basically comprises a fork structure indicated generally by the numeral 16 which is secured to the ground penetrating end 18 of the rod 12 and which extends therefrom. Fork 16 includes a pair of prongs **16*a* and 16*b* which define a space 16*c* there between. Extending from prong 16*a* is an extension 16*d*. It is seen that both the prongs 16*a* and 16*b* and extension 16*d*** are generally flat and relatively thin.

Formed about the ground penetrating end portion of the rod 12 is an elongated slit 20 that is slightly thicker or wider than the extension **16*d* extending about the fork 16. Slit 20 is designed to receive the extension 16*d* and there is provided a pin 22 that is secured transversely through the rod 12 about the ground penetrating end thereof, and which engages and secures the extension 16*d* within the elongated slot or slit 20 formed in the rod 12. Consequently, pin 22 serves to secure the entire fork structure 16 about the ground penetrating end portion of the rod 12**.

Figure 2:
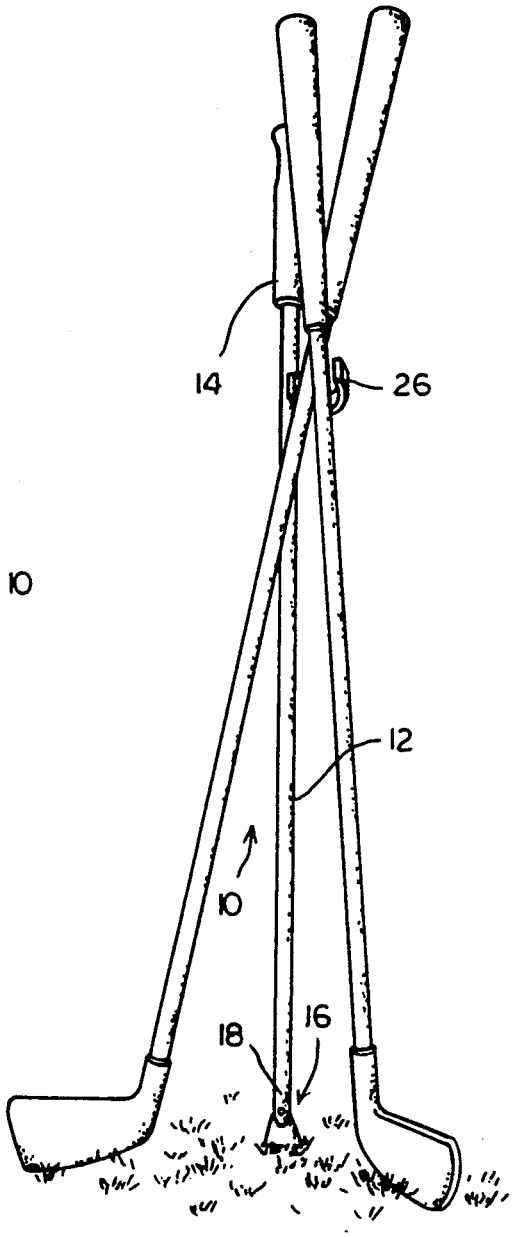
FIG. 2 is a perspective view of the utility golf accessory of the present invention shown extending upwardly from the ground and supporting a pair of golf clubs.
Figure 1A:
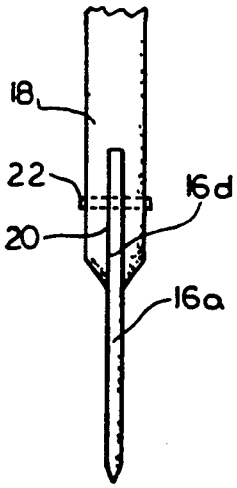
FIG. 1A is a fragmentary view of the ground penetrating end of the golf accessory.

The golf accessory 10 of the present invention is also designed to receive and support golf clubs in an inclined or upright fashion about the green or fairway of a golf course. As seen in FIG. 2, the structure for supporting one or more golf clubs, and particularly engaging the handles of the golf clubs comprise a pivotally mounted hook 26. A pivot pin 24 is secured transversely about the handle-end portion about the golf accessory, and the hook 26 is pivotally mounted to a portion of the pivot pin 24 extending transversely from the rod 12. Consequently, it is appreciated that hook 26 can freely pivot about pivot pin 24, and in fact, can turn and rotate a full 360° about the pivot pin 24.

The purpose of the hook 26 is first to support one or more golf clubs in a standing position, or in an inclined position. Note in FIG. 2 how the hook receives and supports one or more golf clubs. This is particularly advantageous in and around the green when the golfer has removed a plurality of golf clubs from his bag and desires to discard or lay down one or more clubs while he is using a single club. This is particularly advantageous in situations where the green and the grass surrounding the grass is wet or damp since by essentially propping the golf clubs up and supporting them about the hook 26, the handles of the golf clubs are protected from being exposed to the moisture.

Since hook 26 can rotate or swivel about pivot pin 24, it is appreciated that when the golf accessory 10 is disposed within a golfer's golf bag, that the hook 26 can be rotated so that it can essentially extend around the top edge of the golf bag supporting the rod 12 and golf accessory 10 within the golf bag such that the ground penetrating end portion of the rod 12 does not reach or engage the bottom of the bag. Essentially, the hook 26 can support the entire golf assessory 10 about the bag.

As already noted, the purpose of the fork 16 is to repair ball marks in the green and other damage to the golf course, such as divots. The present invention makes it very easy for people to repair golf balls and other damage to the golf course since the golfer does not have to bend and essentially reach the ground area with his hands. With the present invention, a golfer can essentially remain upright and still repair ball marks and divots, etc. This will greatly encourage the repair of ball marks and divots, and will improve the overall quality of golf courses where players carry and use the golf accessory made according to the present invention.

From the foregoing specification and discussion, it is appreciated that the golf accessory of the present invention has many advantages, and is extremely useful. Not only does the golf accessory 10 of the present invention support golf clubs such that the handle portions are not required to be laid on wet greens and wet fairways, but the same golf accessory can be used by the players to efficiently and effectively repair ball marks and divots.

The present invention may, of course, be carried out in other specific ways than those herein set forth without departing from the spirit and essential characteristics of the invention. The present embodiment are, therefore, to be considered in all respects as illustrative and not restrictive and all changes coming within the meaning and equivalency range of the appended claims are intended to be embraced therein.

What is claimed is:

1. A utility golf accessory comprising: an elongated rod having a handle end a ground penetrating end; a handle formed on the handle end of the elongated rod; a ground penetrating fork secured to the ground penetrating end of the elongated rod for repairing ball marks and divots; and means disposed on the handle end of the elongated rod for receiving and supporting the handle end of golf clubs, the support means including a pivot pin secured to the handle and extending therefrom and a hook pivotally mounted about the pivot pin and rotatable thereabout and wherein the hook is adapted to receive the handle end of one or more golf clubs while the utility golf accessory is anchored in the ground.

2. The utility golf accessory of claim 1 wherein the rod includes a terminal end formed on the ground penetrating end and wherein there is provided a thin slot formed in the rod with the slot extending from the terminal end towards the handle end of the rod, and wherein the ground penetrating fork includes a flat securing extension that extends into the slot and wherein there is provided a pin extending transversely through the ground penetrating end of the rod and which engages the extension of the ground penetrating fork for securing the same in the slot.

3. The utility golf accessory of claim 2 wherein the ground penetrating fork is replaceable.

* * * * *